US008296873B2

(12) United States Patent
Dragovich

(10) Patent No.: US 8,296,873 B2
(45) Date of Patent: Oct. 30, 2012

(54) PORTABLE SPA ENCLOSURE

(75) Inventor: Jake Dragovich, Vista, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 1186 days.

(21) Appl. No.: 11/752,124

(22) Filed: May 22, 2007

(65) Prior Publication Data

US 2008/0289093 A1 Nov. 27, 2008

(51) Int. Cl.
*A47K 3/00* (2006.01)

(52) U.S. Cl. ..... 4/592; 4/584; 362/147; 362/151

(58) Field of Classification Search ..... 4/541.1–541.6, 4/584, 589, 590, 592, 593; 312/265.1–265.4, 312/140; 220/327, 784, 786
See application file for complete search history.

(56) References Cited

U.S. PATENT DOCUMENTS 712,842 A * 11/1902 Paulle ..... 312/140
3,271,568 A * 9/1966 Lundberg ..... 40/545
4,999,754 A * 3/1991 Gary ..... 362/237
5,943,709 A * 8/1999 Chiu ..... 4/506
6,062,704 A * 5/2000 Holder ..... 362/147
6,076,694 A * 6/2000 Ragot ..... 220/23.83
6,389,768 B1 * 5/2002 Gagne et al. ..... 52/309.9
6,561,670 B1 * 5/2003 Jongewaard et al. ..... 362/147
6,763,532 B2 * 7/2004 Gardenier et al. ..... 4/541.1
6,802,087 B1 * 10/2004 Podue et al. ..... 4/541.1
2004/0221383 A1 * 11/2004 Sieger et al. ..... 4/584
2005/0132487 A1 * 6/2005 Layfield et al. ..... 4/541.1

OTHER PUBLICATIONS

Copenheaver, Blaine. Aug. 13, 2008. Written Opinion of the International Searching Authority for PCT/US2008/062363.*

* cited by examiner

*Primary Examiner* — Huyen Le
*Assistant Examiner* — Erin Deery
(74) *Attorney, Agent, or Firm* — Greenberg Traurig, LLP; Franklin D. Ubell

(57) ABSTRACT

A portable spa enclosure provides an aesthetically pleasing cover for pre-manufactured spas. Additionally, spa hardware is concealed by the spa enclosure, while lighting is recessed to provide a "soft" light solution.

16 Claims, 5 Drawing Sheets

PORTABLE SPA ENCLOSURE

FIELD OF INVENTION

This invention relates to enclosures for spas.

BACKGROUND

Hot tubs are pools designed to hold heated water and are used for soaking, relaxation, massage, or hydrotherapy. Many users of hot tubs have their hot tubs installed at their homes. Naturally, these users seek to have tubs that enhance the aesthetics of the location in which the hot tub is installed.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
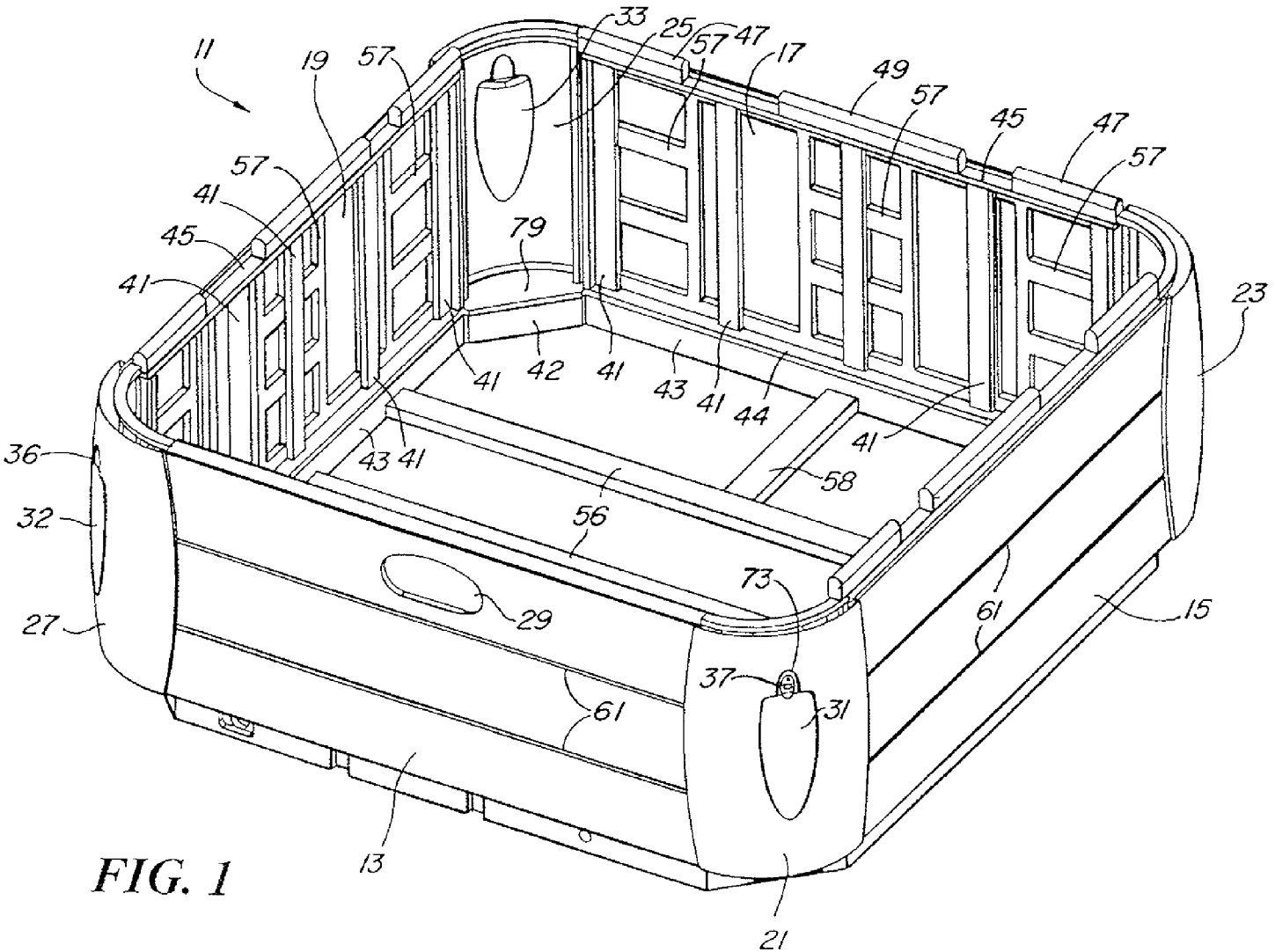
FIG. 1 is a perspective view of an embodiment of a portable spa enclosure according to the present disclosure.
Figure 2:
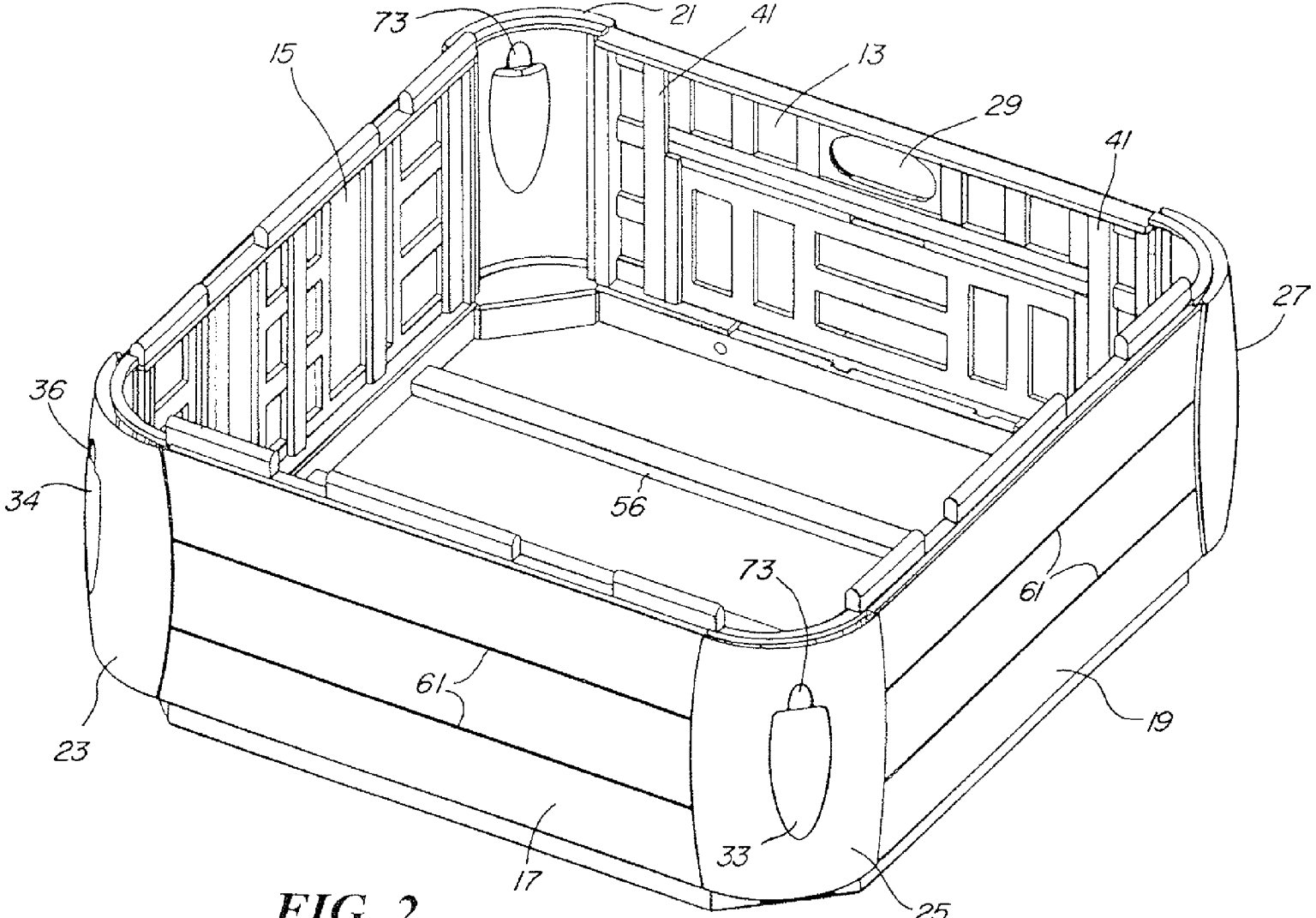
FIG. 2 is a perspective view of an embodiment of a portable spa enclosure according to the present disclosure.
Figure 4:
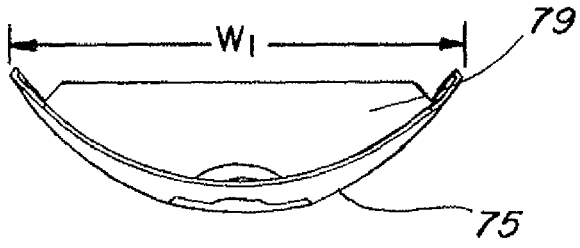
FIG. 4 is a bottom view of an embodiment of a corner piece of a portable spa enclosure according to the present disclosure.
Figure 3:
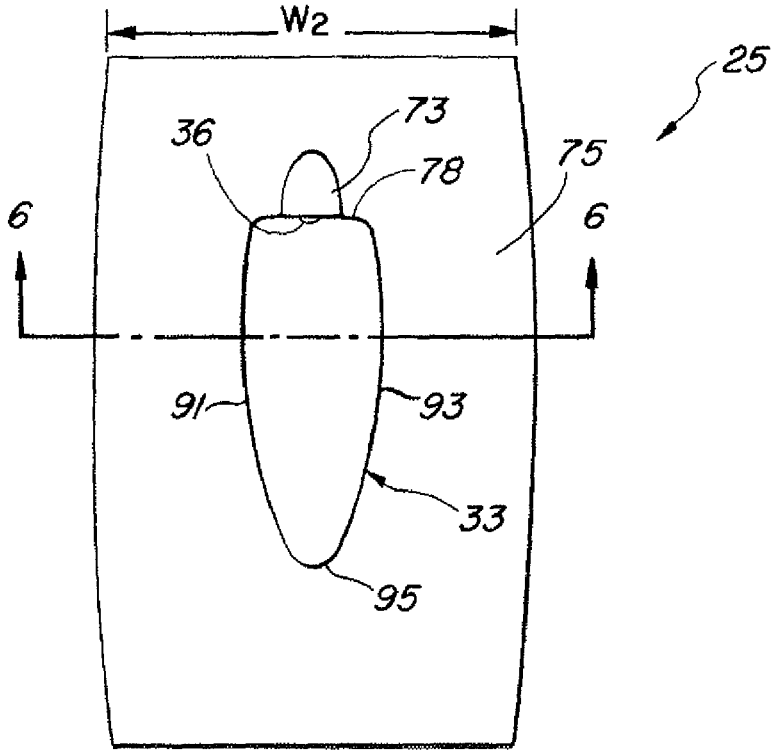
FIG. 3 is a front view of an embodiment of a corner piece of a portable spa enclosure according to the present disclosure.
Figure 5:
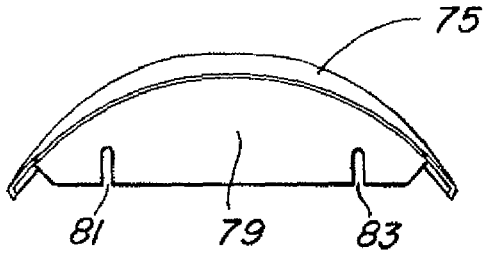
FIG. 5 is a top view of an embodiment of a corner piece of a portable spa enclosure according to the present disclosure.

An illustrative embodiment of a decorative spa enclosure is shown in FIGS. 1 and 2. The enclosure 11 includes four side panels 13, 15, 17, 19. Three of the side panels 15, 17, 19 may be identically constructed while side panel 13 is provided with an opening 29 for purposes of installing a spa equipment control panel.

At each of the four corners of the enclosure 11, respective side panels interface with corner pieces 21, 23, 25, 27. Each of the corner pieces 21, 23, 25, 27 is preferably a molded plastic part, each having an elongated scallop or depression 31, 34, 33, 32 formed therein. A downlight 36 is located above each scallop or depression 31, 34, 33, 32 so as to illuminate it to provide an aesthetically pleasing appearance at night.

Each of the side panels 13, 15, 17, 19 are preferably formed from a thin, e.g., 0.350 inches thick, plastic sheet, and are supported by respective backing frame structures 57. The frame structures 57 are shown as comprising a rectangular lattice work in FIGS. 1 and 2. However, they could be variously configured, as those skilled in the art will appreciate.

The panels 13, 15, 17, 19 and corner pieces 21, 23, 25, 27 are attached to and supported by an internal cabinet structure. The cabinet structure includes lower horizontal frame members 43, 44 and vertical support members 41, as well as upper horizontal frame members 45. The lower horizontal frame support member 44 is fixedly attached to the adjacent horizontal frame member 43' The vertical frame members 41 are fixedly attached to the lower horizontal frame member 44 and to the upper horizontal frame member 45. Base frame members 56, 58 are further provided to enhance the rigidity of the structure. The frame and cabinet structures shown may be fabricated from wood, composite, or other suitable materials.

Additionally, bullnoses e.g., 47, 49 are disposed around the upper periphery of the frame structure. These bullnoses 47, 49 are provided to support an outer lip of a cooperating spa shell, which preferably conceals them to form a complete spa unit, for example, as illustrated in FIG. 7.

Figure 6:
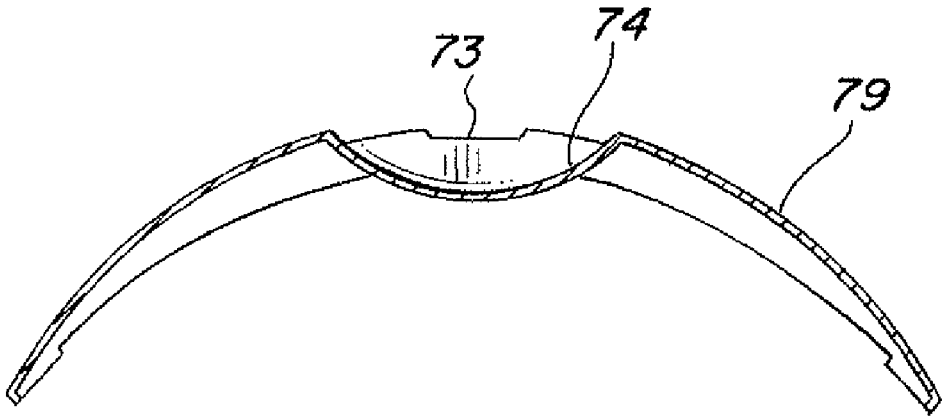
FIG. 6 is a cross sectional view of an embodiment of a corner piece of a portable spa enclosure according to the present disclosure.

The construction of one of the corner pieces 25 is illustrated in further detail in FIGS. 3 to 6. The corner piece 25 is preferably thermo formed from a single ABS plastic sheet using an appropriate mold. The corner piece 25 includes a curved, contoured body portion 75 and a scallop or depression 33, which includes a smaller depression 73 that provides for installation of a cover buckle 37 provided to facilitate tie-down of a spa cover. The scallop or depression 33 has a generally linear upper edge 78 with respective sides 91, 93 curving symmetrically toward an end point 95 to create a shield-like shape. In FIG. 6, numeral "74" indicates the arcuate cross-section of the depression 33.

At the lower end of the corner piece 25 is formed a horizontally extending bottom web 79. The horizontally extending bottom web 79 may include screw recesses 81, 83 for facilitating attachment to the cabinet structure. In FIGS. 3-6, dimension W1 may be, for example, 19.377 inches, while dimension W2 may be 17.738 inches according to one illustrative embodiment.

Figure 7:
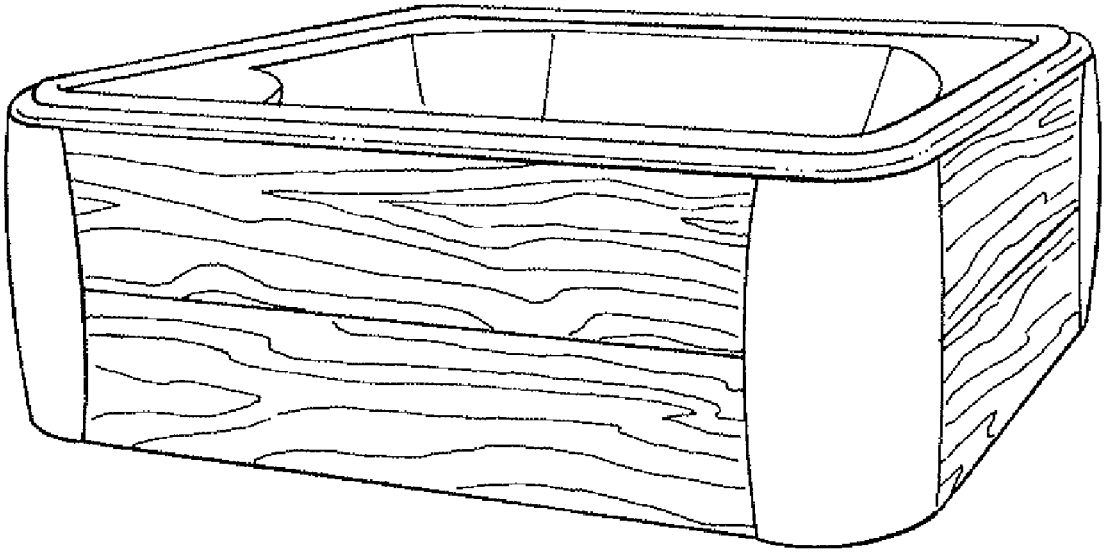
FIG. 7 is a perspective view of an embodiment of a portable spa enclosure according to the present disclosure.

Each of the respective side panels 13, 15, 17, 19 includes first and second horizontal grooves 61, with use of a single groove as illustrated in FIG. 7 being an optional alternative. The side panels are preferably formed of ABS plastic with an acrylic film applied to the front surface thereof. Preferably the plastic and film are extruded together at the same time ("co-extruded"). This process may enable, for example, a decorative wood-grain effect to be obtained. With such a wood grain appearance, the flat plastic panel gives the appearance of wood siding, as illustrated in FIG. 7.

Figure 8:
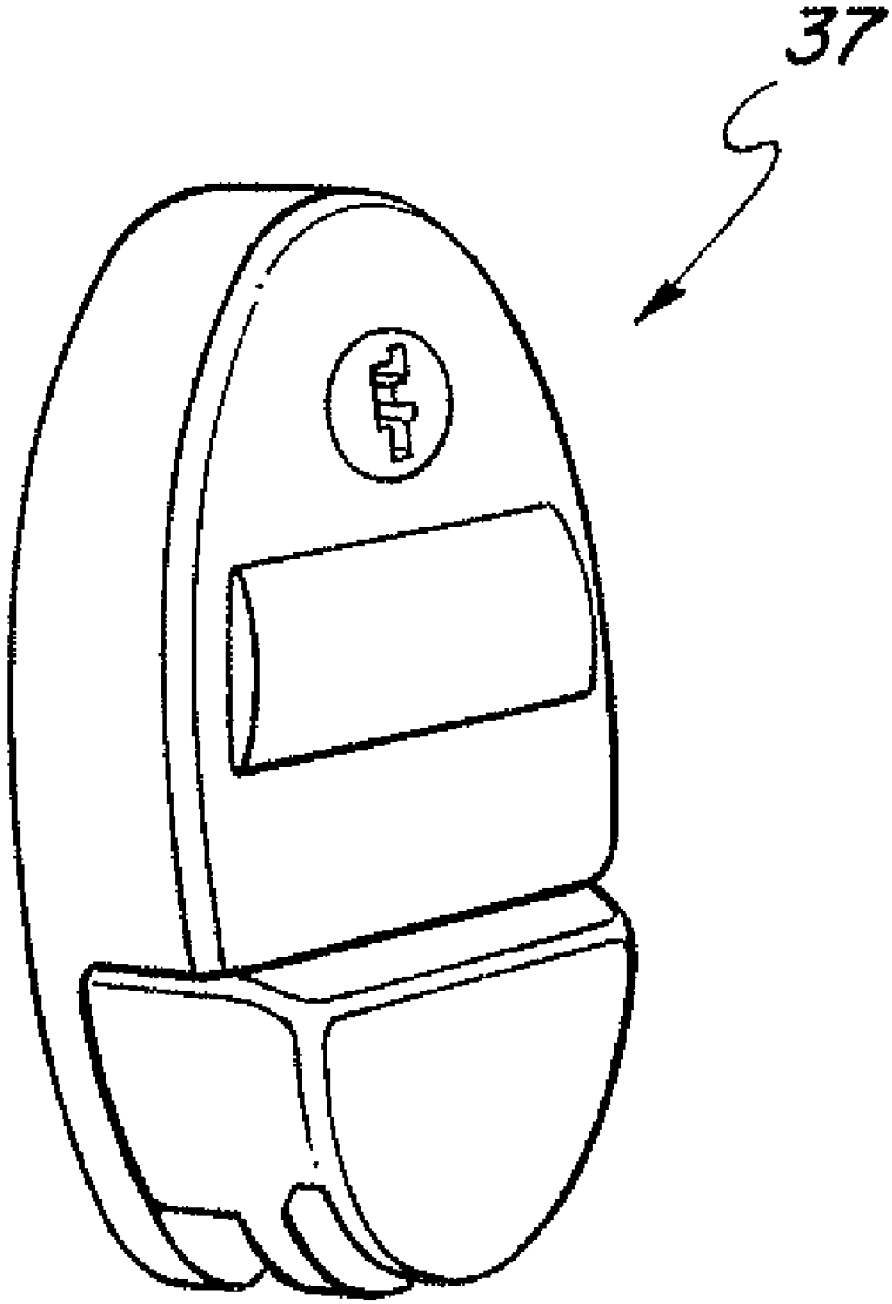
FIG. 8 is a perspective view of an embodiment of a buckle that is used in conjunction with a corner piece of a portable spa enclosure according to the present disclosure.

FIG. 8 illustrates a buckle 37 used for connection of a spa cover, according to embodiments. The buckle may be equipped with a locking mechanism as a safety feature to prevent the spa cover from being removed without the use of a key or combination.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A spa enclosure comprising:

first, second, third, and fourth rectangular plastic side panels;

first, second, third, and fourth molded plastic corner pieces mating at respective edges with the side panels to form a smooth outer contour; and each corner piece comprising an arcuately curved body portion, each body portion including a depression centrally located therein, the depression having a generally linear upper edge with respective sides at respective ends of the upper edge, each side curving downwardly and joining at an end point to create a shield-like shape, each depression further being arcuate in cross-section; and a downlight mounted along each said generally linear upper edge of each depression, each downlight being positioned to illuminate a respective one of said depressions.

2. The spa enclosure of claim 1, wherein one of the first, second, third, and fourth molded plastic corner pieces further comprises a spa cover anchoring member.

3. The spa enclosure of claim 1, wherein each of the panels and molded plastic corner pieces are attached to an internal frame structure such that the rectangular panels and the corner pieces form a generally rectangular enclosure and wherein a spa shell is positioned within said enclosure.

4. The spa enclosure of claim 3, wherein the frame structure includes a plurality of bull nose elements shaped to support an outer lip of said spa shell; and wherein each said corner piece further includes a horizontally extending web comprising one or more recesses for enabling one or more fastening mechanisms to attach each corner piece to the frame structure.

5. The spa enclosure of claim 2, wherein the spa cover anchoring member is secured via a locking system to allow removal of a spa cover only when the locking system is in an unlocked state.

6. The spa enclosure of claim 1, wherein at least one of the first, second, third, and fourth rectangular plastic side panels are designed to accommodate the plumbing of a spa.

7. The spa enclosure of claim 1, wherein each of the side panels is formed from ABS plastic.

8. The spa enclosure of claim 7, wherein each of the side panels is further formed using an acrylic film applied to a front surface of the ABS plastic; and wherein the ABS plastic and the acrylic film are coextruded to form a decorative feature.

9. The spa enclosure of claim 8, wherein the decorative feature simulates a wood-grain effect.

10. An apparatus comprising:

first, second, third, and fourth rectangular plastic side panels;

first, second, third, and fourth molded plastic corner pieces mating at respective edges with the panel members;

an internal frame structure to which each rectangular side panel and each molded plastic corner piece is attached to form a rectangular enclosure having a smooth outer contour;

a spa shell or tub positioned within said frame structure;

each corner piece comprising an arcuately curved body portion, each body portion including a depression centrally located therein, the depression having a generally linear upper edge with respective sides at respective ends of the upper edge, each side curving downwardly and joining at an end point to create a shield-like shape, each depression further being arcuate in cross-section;

a downlight mounted along each said generally linear upper edge of each depression, each downlight being positioned to illuminate a respective one of said depressions;

the frame structure further including a plurality of bull nose elements shaped to support an outer lip of said spa shell; wherein each said corner piece further includes a horizontally extending web comprising one or more recesses for enabling one or more fastening mechanisms to attach each corner piece to the frame structure.

11. The apparatus of claim 10 further comprising a spa cover anchor member mounted in one of said corner pieces and, wherein the spa cover anchoring member is secured via a locking system to allow removal of a spa cover only when the locking system is in an unlocked state.

12. The apparatus of claim 10, wherein the side panels are formed from ABS plastic.

13. The apparatus of claim 12, wherein the side panels are further formed using an acrylic film applied to a front surface of the ABS plastic; and wherein the ABS plastic and the acrylic film are coextruded to form a decorative feature.

14. The apparatus of claim 13, wherein the decorative feature simulates a wood-grain effect.

15. The apparatus of claim 1, wherein said depression is arcuate in horizontal cross-section.

16. The apparatus of claim 10, wherein said depression is arcuate in horizontal cross-section.

* * * * *